US010060068B2

(12) United States Patent
Carrer et al.

(10) Patent No.: US 10,060,068 B2
(45) Date of Patent: Aug. 28, 2018

(54) WASHING MACHINE WITH DETECTION OF VIBRATIONS OF THE WASHING TUB OR CHAMBER

(75) Inventors: Giorgio Carrer, Turin (IT); Ugo Gaino, Druento (IT); Massimo Davi, Bussoleno (IT)

(73) Assignee: ELBI INTERNATIONAL S.P.A., Turin (IT)

( * ) Notice: Subject to any disclaimer, the term of this patent is extended or adjusted under 35 U.S.C. 154(b) by 1142 days.

(21) Appl. No.: 13/988,427

(22) PCT Filed: Nov. 30, 2011

(86) PCT No.: PCT/IB2011/055381

§ 371 (c)(1),
(2), (4) Date: May 20, 2013

(87) PCT Pub. No.: WO2012/073200

PCT Pub. Date: Jun. 7, 2012

(65) Prior Publication Data

US 2013/0233027 A1 Sep. 12, 2013

(30) Foreign Application Priority Data

Dec. 1, 2010 (IT) ..... TO2010A0957

(51) Int. Cl.

| | |
|---|---|
| ***D06F 39/00*** | (2006.01) |
| ***D06F 33/02*** | (2006.01) |
| ***D06F 37/20*** | (2006.01) |
| ***D06F 39/08*** | (2006.01) |

(52) U.S. Cl.

CPC ..... *D06F 39/004* (2013.01); *D06F 33/02* (2013.01); *D06F 37/203* (2013.01); *D06F 39/087* (2013.01)

(58) Field of Classification Search

CPC .... D06F 37/203; D06F 39/087; D06F 37/225; D06F 37/245; F16F 9/3292

See application file for complete search history.

(56) References Cited

U.S. PATENT DOCUMENTS 6,292,966 B1 * 9/2001 Lim ..... D06F 39/087 68/12.05
7,180,285 B2 2/2007 Bindocci et al.
(Continued)

FOREIGN PATENT DOCUMENTS

DE 19618498 A1 * 11/1997 ..... A47L 15/0049
DE 198 35 865 A1 2/1999
(Continued)

OTHER PUBLICATIONS

DE19618498—Machine Translation, Nov. 1997.*
(Continued)

*Primary Examiner* — Marc Lorenzi
(74) *Attorney, Agent, or Firm* — Sughrue Mion, PLLC

(57) ABSTRACT

A washing machine which detects vibrations of the washing tub or chamber. The machine (M) includes a support structure (S), inside which there is suspended a washing chamber or tub (T) wherein there is rotatably mounted a basket (B) for clothes and the like, and a pressure transducing device (1), which includes a support casing (2, 3) connected to the washing chamber or tub (T), and connected to a pipe or hose (P) which extends inside this chamber or tub (T), and with which there are associated an electronic circuit (17) predisposed for processing signals generated by the transducer (1) to provide an indication of the level of the washing bath (WB) in the chamber or tub (T). An electronic accelerometer (30) secured to the support casing (2, 3) of the pressure transducing device (1) and associated with said electronic circuit means (17), generates electrical signals indicative of the amplitude of the vibrations of the washing chamber or tub (T).

4 Claims, 6 Drawing Sheets

(56) References Cited

U.S. PATENT DOCUMENTS

| | | | | |
|---|---|---|---|---|
| 2005/0028844 | A1* | 2/2005 | Lee | A47L 15/421 134/57 D |
| 2005/0140359 | A1 | 6/2005 | Bindocci et al. | |
| 2006/0185097 | A1 | 8/2006 | Weinmann et al. | |
| 2006/0191337 | A1* | 8/2006 | Marioni | D06F 37/203 73/462 |
| 2008/0066238 | A1* | 3/2008 | Lee | D06F 37/203 8/159 |
| 2008/0264111 | A1 | 10/2008 | Giordano | |
| 2010/0251487 | A1* | 10/2010 | Bolduan | D06F 33/02 8/159 |

FOREIGN PATENT DOCUMENTS

| | | | |
|---|---|---|---|
| DE | 10 2008 017284 | A1 | 10/2009 |
| EP | 1 087 052 | A2 | 3/2001 |
| EP | 1 693 499 | A2 | 8/2006 |
| GB | 2 073 257 | A | 10/1981 |
| WO | 03/014455 | A2 | 2/2003 |

OTHER PUBLICATIONS

DE102008017284—Machine Translation, Oct. 2009.*
DE19835865—Machine Translation, Feb. 1999.*
Mike Bugnacki, et al., "A Micromachined Thermal Accelerometer for Motion, Inclination, and Vibration Measurement", Sensors, North American Technology, Jun. 2001, pp. 98-104, vol. 18, No. 6, XP-001020754.

* cited by examiner

WASHING MACHINE WITH DETECTION OF VIBRATIONS OF THE WASHING TUB OR CHAMBER

CROSS REFERENCE TO RELATED APPLICATIONS

This application is a National Stage of International Application No. PCT/IB2011/055381 filed Nov. 30, 2011, claiming priority based on Italian Patent Application No. TO2010A000957, filed Dec. 1, 2010, the contents of all of which are incorporated herein by reference in their entirety

BACKGROUND OF THE INVENTION

Field of the Invention

The present invention refers in general to washing machines, and in particular to washing machines for clothes and the like.

Background

More specifically, the invention has as its subject a washing machine of the type comprising

- a supporting structure, inside which there is elastically suspended a washing chamber or tub wherein there is rotatably mounted a basket for clothes and the like; and
- a pressure transducing device, including a support casing connected to said washing chamber or tub, and connected to a pipe or hose which extends inside the washing chamber, and with which there are associated electronic circuit means predisposed for processing signals generated by said transducer to provide an indication of the level of the washing bath in said chamber.

A washing machine of this type is described for example in German patent DE 198 35 865 C2, in the name of the same Applicant.

An object of the present invention is to create an improved machine of the type defined above.

SUMMARY OF THE INVENTION

This and other objects are achieved according to the invention with a machine of the type initially specified, characterized in that it further comprises an electronic accelerometer, solid with the support casing of the aforesaid pressure transducing device and connected to said electronic circuit means, which are predisposed for processing signals provided by said accelerometer and providing electrical signals indicative of the amplitude of the vibrations of the washing tub or chamber.

BRIEF DESCRIPTION OF THE DRAWINGS

Further characteristics and advantages of the invention will appear from the detailed description which follows, effected with reference to the attached drawings, provided purely by way of non-limiting example, in which.

DETAILED DESCRIPTION OF THE INVENTION

Figure 1:
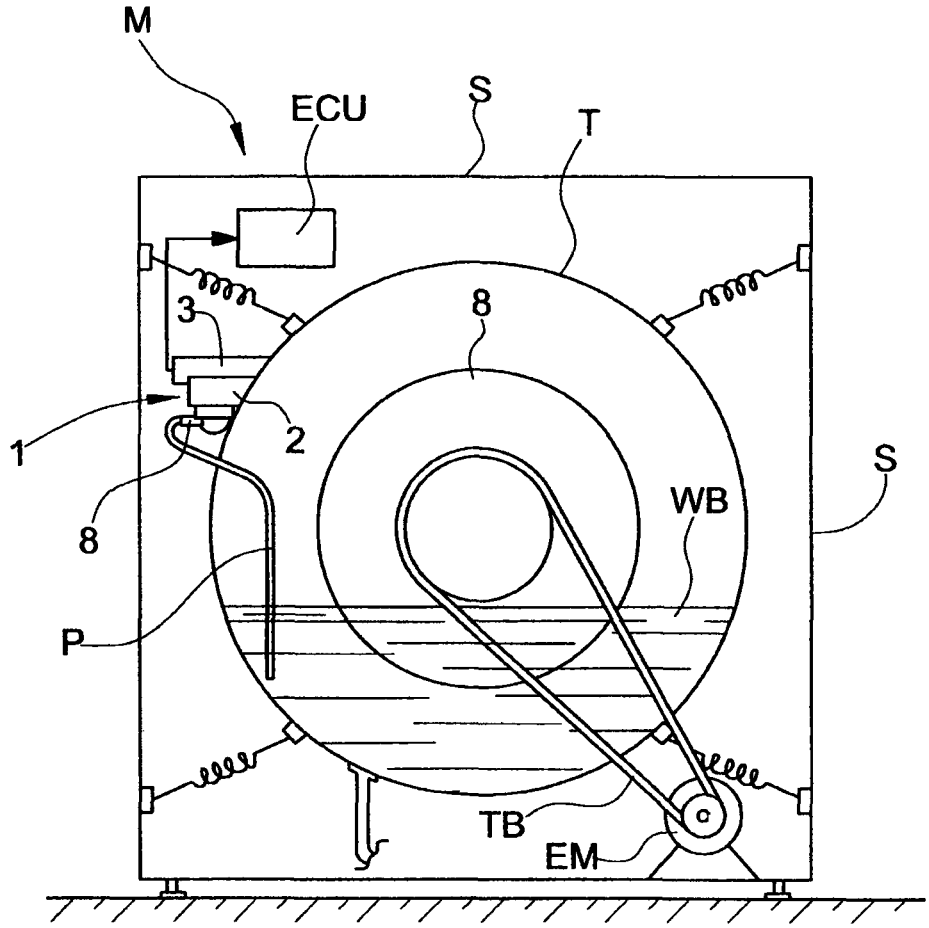
FIG. 1 is a schematic representation of a washing machine according to the present invention.

In FIG. 1, M generally indicates a washing machine, in particular a washing machine for clothes and the like, according to the present invention.

In the embodiment illustrated, the machine M comprises a support structure S, inside which is suspended a washing chamber or tub T.

In the washing tub T there is rotatably mounted a basket B for clothes and the like.

Figure 2:
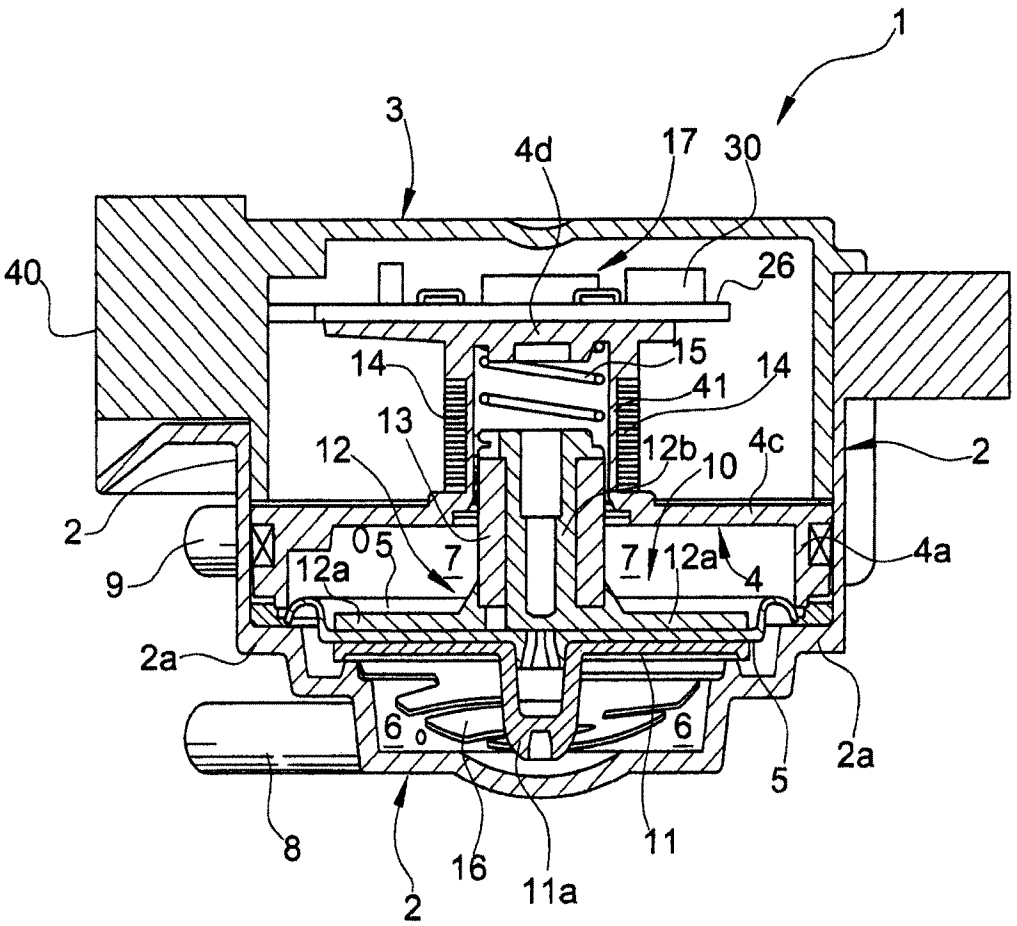
FIG. 2 is a sectioned view of an electrical pressure transducer for the use of a washing machine according to the invention.

A pressure transducing device, generally indicated by 1, is fixed to the washing chamber or tub T. The pressure transducing device 1 is for example of the type described in detail in U.S. Pat. No. 7,180,285 B2 by the same Applicant. In FIG. 2 of the attached drawings, there is visible in any case, by way of non-limiting example, a pressure transducing structure conforming to the aforesaid United States patent, which will however be summarily described later.

With reference to FIG. 1, pressure transducing device 1 is connected to a pipe or hose P which extends inside the washing chamber or tub T.

In its entirety, the assembly formed by the pressure transducing device 1 and the pipe or hose P makes it possible, in a manner in itself known, to perform detection of the level of the washing bath WB in the chamber or tub T.

With reference to FIG. 1, the washing basket B is, in operation, drivable in rotation by means of an electric motor EM, mounted in the supporting structure S of the washing machine M, and coupled to said basket B by means, for example, of a transmission belt TB.

The pressure transducing device 1 is connected to an electronic control unit ECU for controlling the operation of the washing machine M.

With reference in particular to FIG. 2, in the manner of embodiment illustrated by way of example the pressure transducing device comprises a rigid casing formed by a first element 2, substantially in the form of a cup, and by a second element 3, this too being substantially in the form of a cup and partially co-penetrated with the element 2.

Inside the casing of the transducer 1 a support body, generally indicated by 4, is interposed between elements 2 and 3. This body 4 features an annular lower portion 4*a* and a tubular upper portion 4*b*, interconnected by a transverse annular wall 4*c*. The tubular portion 4*b* of the support body 4 is closed at one end by an end wall 4*d*.

An elastic membrane, for example of elastomeric material, is indicated by 5. The periphery of this membrane is clamped so as to form a fluid seal between the annular lower portion 4*a* of the support body 4 and a shoulder 2*a* which forms part of the cup-shaped body 2.

The membrane 5 divides the region comprised between the lower part of the cup-shaped body 2 and the support body 4 into two chambers of variable volume, indicated by 6 and 7.

The cup-shaped body 2 of the casing of the transducer features a tubular connector 8 which allows the introduction of a fluid (air) into chamber 6, and a second tubular connector 9 which puts chamber 7 in communication with the external environment. In operation, the instantaneous position of the membrane 5 depends on the difference between the pressures in chambers 6 and 7. The connector 8 is connected to the pipe or hose P (FIG. 1).

The central part of membrane 5 is connected to a movable apparatus generally indicated by 10. This apparatus comprises a plate 11, with a central protuberance 11*a* snap-engaged (with the interposition of membrane 5) with the head portion 12*a* of an essentially mushroom-shaped body 12.

The plate 11 extends into the chamber 6, while the mushroom-shaped body 12 extends into the chamber 7. This body 12 features a tubular column or spindle 12*b*, around which is arranged an annular cylindrical element 13, made of a ferromagnetic material.

The stem or shaft 12*b* of body 12 and the associated interaction element 13 of ferromagnetic material extend in part axially into the upper tubular portion 4*b* of support body 4. A winding 14 of insulated electrical wire is arranged around portion 4*b* of body 4.

In the embodiment illustrated by way of example, a helical spring 15 is interposed between the end wall 4*d* of support body 4 and the free end of the column or spindle 12*b* of body 12. A further spring 16, essentially conical, is arranged in chamber 6 between the plate 11 and the lower wall of the cup-shaped body 2.

Figure 3:
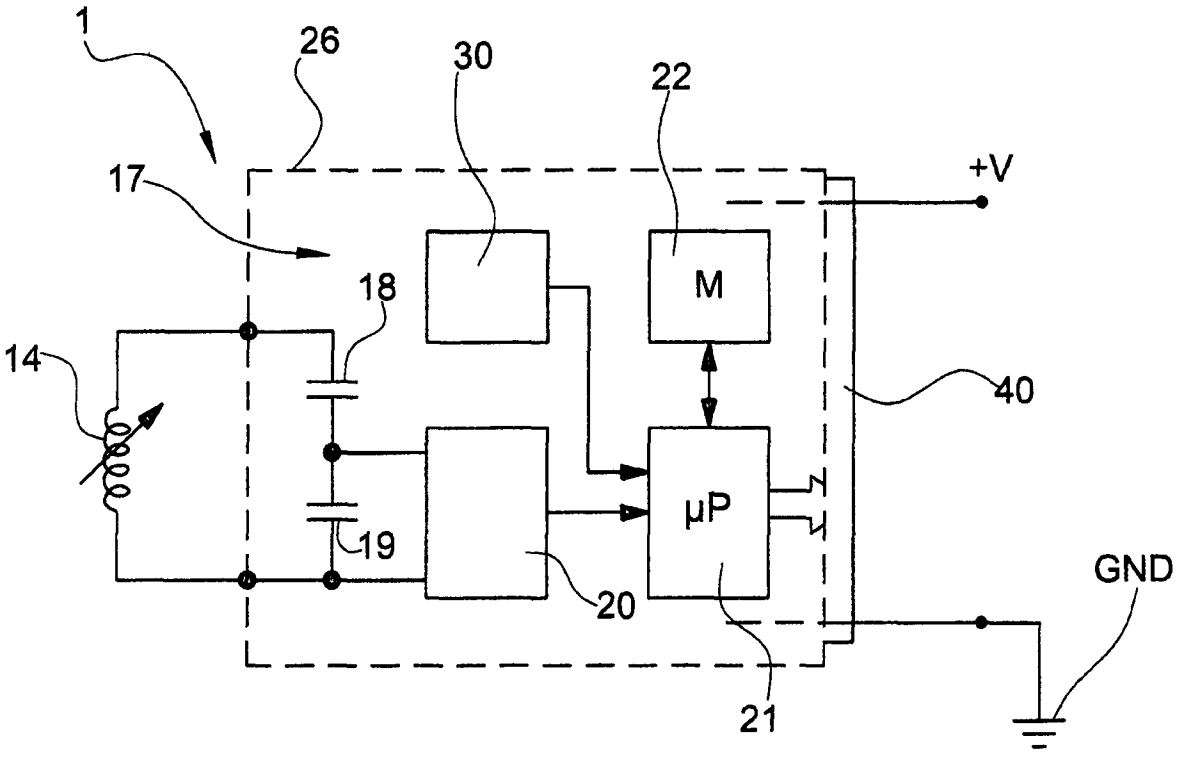
FIG. 3 is a circuit diagram, partly in the form of block diagrams, of the pressure transducer with accelerometer according to FIG. 2.

A circuit board or card 26, carrying components or circuits generally indicated by 17 in FIGS. 2 and 3, is fixed to the end wall 4*d* of support body 4, at the opposite end from the membrane 5. The winding 14 is connected to these circuits.

In operation, the instantaneous position of membrane 5 depends on the difference between the pressures in chambers 6 and 7. In proportion as this difference varies, movable apparatus 10 is axially displaced with respect to winding 14. In proportion as the coupling between the ferromagnetic element 13 and the winding 14 varies, the inductance of the latter also varies.

As is schematically illustrated in FIG. 3, the circuits 17 carried by plate 26 comprise, for example, condensers 18 and 19 coupled to the winding 14 and forming therewith a circuit LC. This circuit LC is connected to a circuit 20 of a type known in itself, which in operation generates an electrical signal a parameter of which, such as for example its frequency, varies with the inductance of the winding 14.

Conveniently, the circuit 20 can be connected to an input of a microprocessor 21, to which are linked electronic memory devices 22.

With reference to FIGS. 2 and 3, the circuit board or card 26 also carries an electronic accelerometer 30, conveniently itself connected to the microprocessor 21, as is shown in FIG. 3.

The accelerometer 30, which is mechanically integral with the support casing 2, 3 of the pressure transducing device 1, is preferably of the type known as three-dimensional (3d), and is integrated into a single chip.

The microprocessor 21 is conveniently predisposed to process the signals supplied to it by circuit 20, as well as the signals provided by the accelerometer 30. On the basis of the signals provided by circuit 20, the microprocessor 21 generates (and provides as output to an interface connector 40) signals indicative of the level of the washing bath WB in the chamber or tub T. On the basis of the signals provided by the accelerometer 30, the microprocessor 21 is predisposed for generating electrical signals indicative of the amplitude (preferably along three perpendicular coordinate axes) of the vibrations of the washing tub or chamber T.

Conveniently, although not necessarily, the microprocessor 21 can be predisposed for actuating the functions of calibrating the characteristic of pressure transducer 1, in conformity with the teachings contained in U.S. Pat. No. 7,180,285 B2, already mentioned above.

In the embodiment illustrated in FIGS. 1 and 2, the apparatus 10 is movable (relative to the casing 2, 3 and the winding 14) in a vertical direction (axis Z).

The component along axis Z of the vibrations of the chamber or tub T is capable of causing corresponding oscillations along axis Z of the movable apparatus 10 with respect to the winding 14 of the pressure transducer 1. The microprocessor 21 can therefore be predisposed for detecting, on the basis of analysis of the signals provided by the circuit 20, the component along axis Z of the vibrations of chamber or tub T. This information can be compared with the information which the microprocessor 21 draws from the signals of accelerometer 30, to detect any operating abnormalities of the latter or of the pressure transducer 1.

Figure 4:
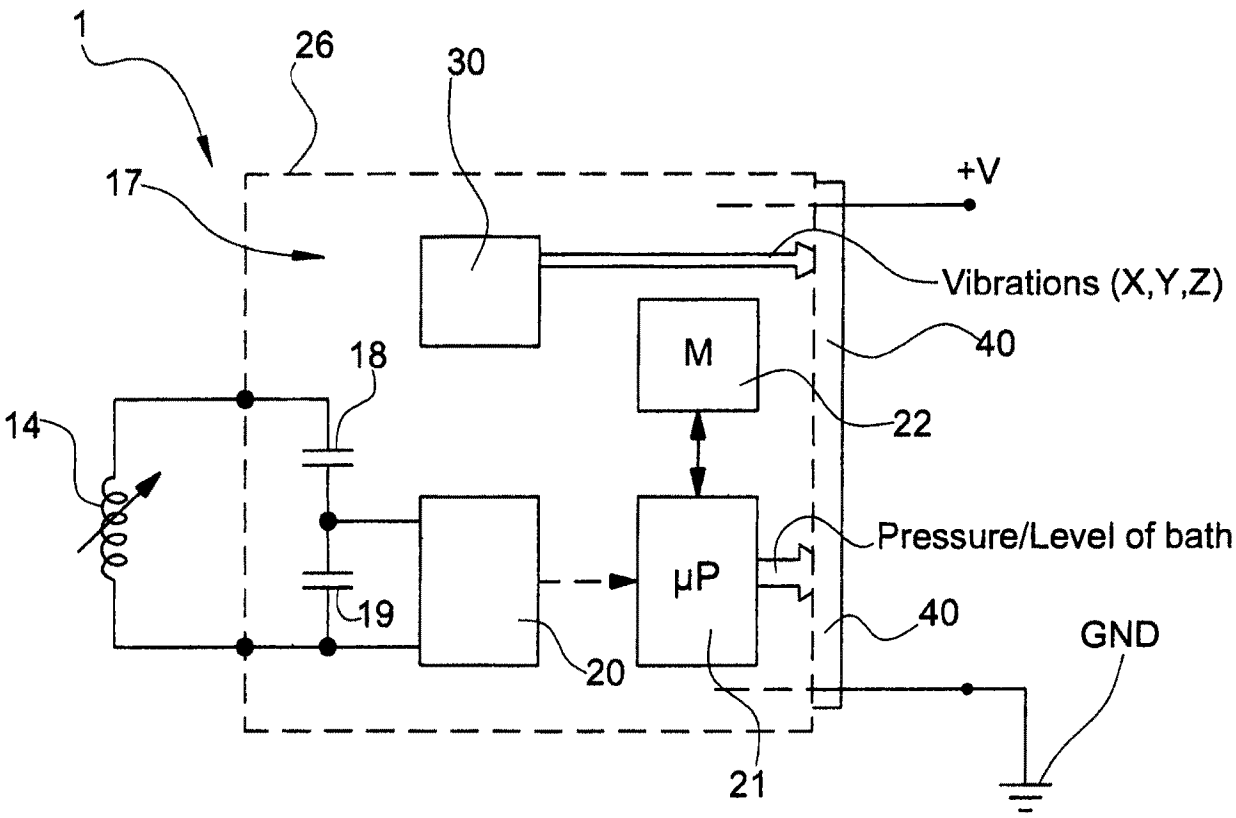
FIGS. 4 to 6 are circuit diagrams, partly in the form of block diagrams, of variants of embodiment of the pressure transducer with accelerometer for a machine according to the invention.
Figure 5:
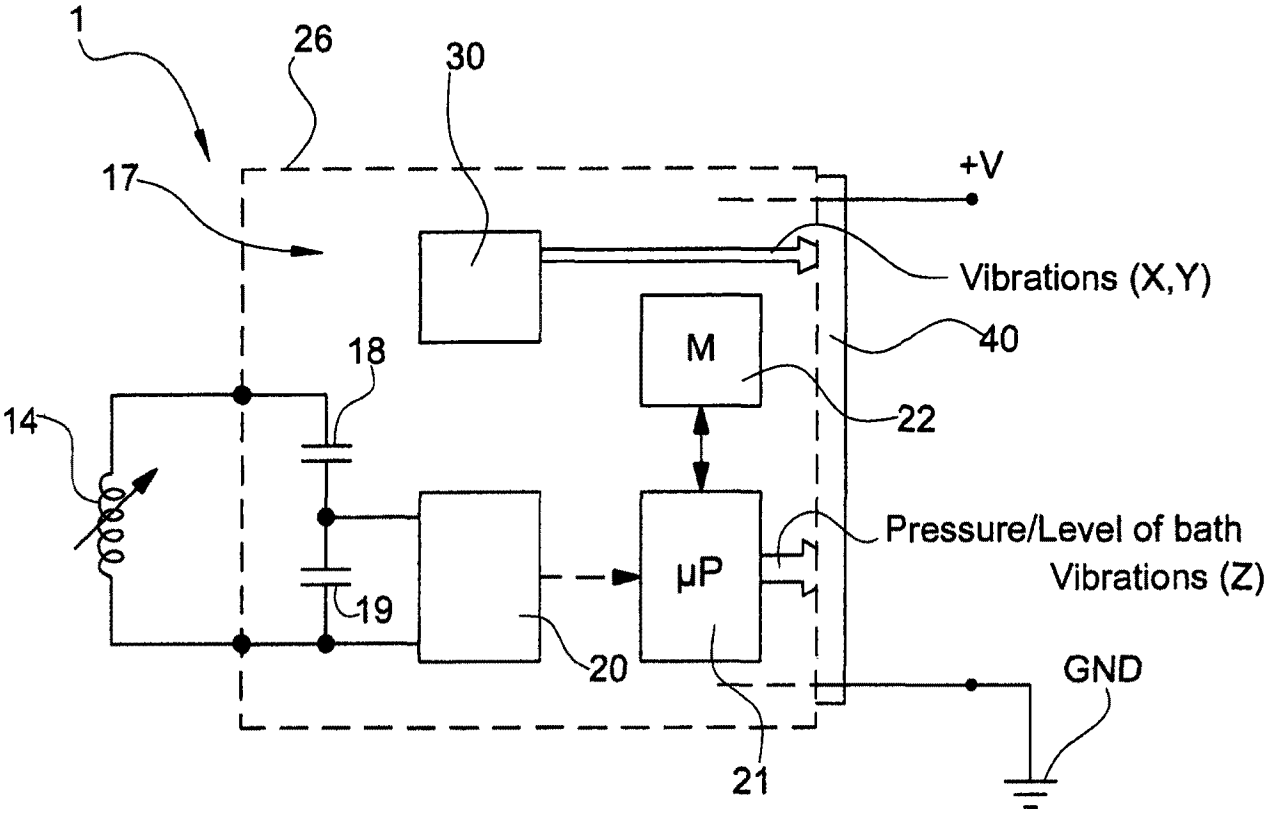
Figure 6:
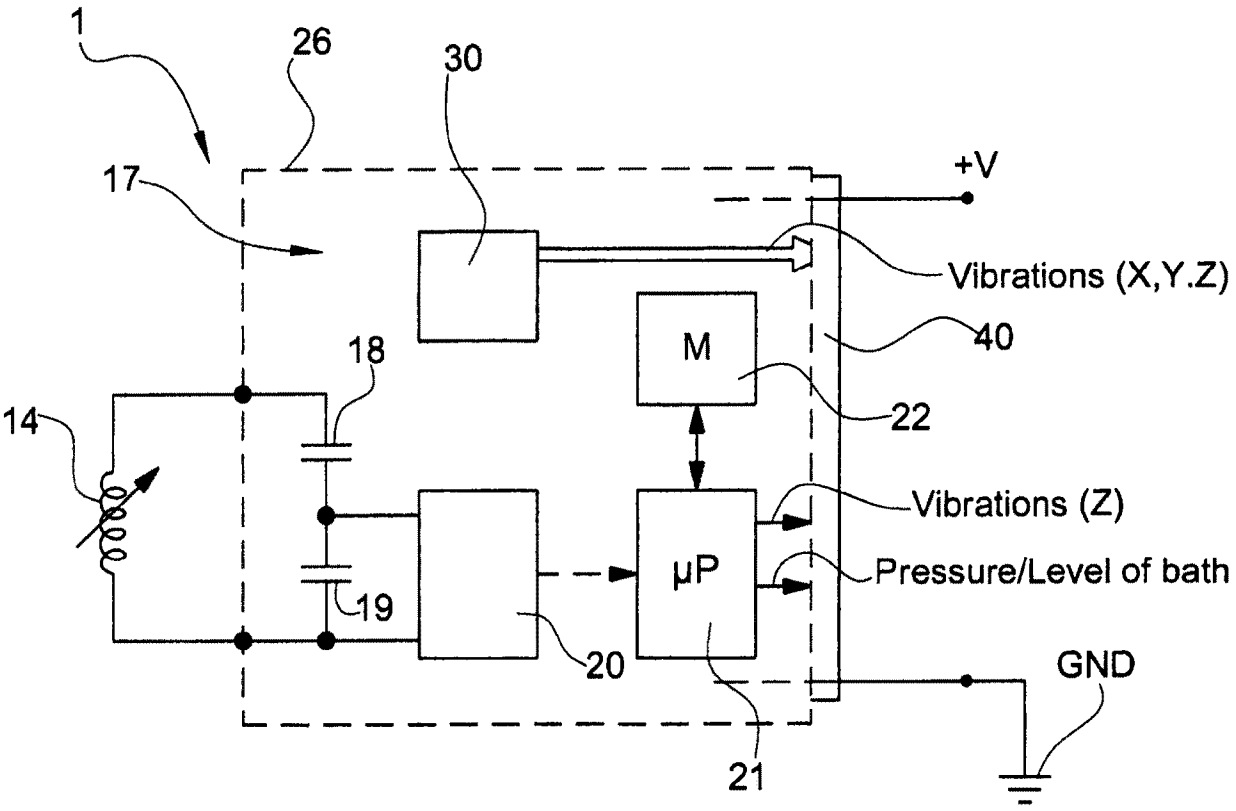

FIGS. 4-6 show diagrams of variant embodiments. In these drawings, parts and components already described are assigned the same reference numbers as are used above.

With reference to FIGS. 2 and 4, circuit board or card 26 carries an electronic accelerometer 30 which is conveniently connected to the interface connector 40.

On the basis of the signals provided by the circuit 20, the microprocessor 21 generates signals indicative of the level of the washing bath WB in the chamber or tub T.

The accelerometer 30, which is mechanically integral with the support casing 2, 3 of the pressure transducing device 1, is preferably of the type known as three-dimensional (3d), and is integrated into a single chip.

This accelerometer 30 is predisposed for generating electrical signals indicative of the amplitude (preferably along three perpendicular coordinate axes X, Y and Z) of the vibrations of the washing tub or chamber T.

With reference to FIGS. 2 and 5, in the variant illustrated therein the circuit board or card 26 carries an electronic accelerometer 30 which is conveniently connected to the interface connector 40.

On the basis of the signals provided by the circuit 20, the microprocessor 21 generates signals indicative of the level of the washing bath WB in the chamber or tub T, and also generates electrical signals indicative of the amplitude of the vibrations of the washing tub or chamber T in the vertical direction (axis Z).

The accelerometer 30, which is mechanically integral with support casing 2, 3 of the pressure transducing device 1, is preferably of the type known as bi-dimensional (2d), and is integrated into a single chip.

The accelerometer 30 is predisposed for generating electrical signals indicative of the amplitude (preferably along two perpendicular coordinate axes X, Y) of the vibrations of the washing tub or chamber T.

With reference to FIGS. 2 and 6, the circuit board or card 26 carries an electronic accelerometer 30 conveniently connected to the interface connector 40.

On the basis of the signals provided by the circuit 20, the microprocessor 21 generates signals indicative of the level of the washing bath WB in the chamber or tub T, and also generates an electrical signal indicative of the amplitude of the vibrations of the washing tub or chamber T along axis Z. This electrical signal generated by the microprocessor 21 can be considered a comparison signal for detecting any malfunctions of the accelerometer 30, or of pressure transducer 1.

The accelerometer 30, which is mechanically integral with the support casing 2, 3 of the pressure transducing device 1, is preferably of the type known as three-dimensional (3d), integrated into a single chip, and predisposed for generating electrical signals indicative of the amplitude (preferably along three perpendicular coordinate axes X, Y and Z) of the vibrations of the washing tub or chamber T.

Naturally, without affecting the principle of the invention, the forms of embodiment and details of execution may be widely varied with respect to what has been described and illustrated purely by way of non-limiting example, without for this reason departing from the scope of the invention as defined in the attached claims.

The invention claimed is:

1. A washing machine, comprising:

a supporting structure, inside which there is suspended a washing chamber or tub wherein there is rotatably mounted a basket;

a pressure transducing device, including a support casing connected to said washing chamber or tub, and connected to a pipe or hose which extends inside said washing chamber or tub, and to which there is associated a microprocessor for processing signals generated by said pressure transducing device to provide an indication of a level of a washing bath in said washing chamber or tub; and an electronic accelerometer solid with the support casing of the pressure transducing device and associated to said microprocessor, for providing electrical signals indicative of an amplitude of vibrations of the washing chamber or tub along a first, vertical axis, wherein said microprocessor generates, on the basis of the signals from the pressure transducing device, signals or data indicative of the amplitude of the vibrations of the washing chamber or tub along the first, vertical axis, and wherein the microprocessor compares information drawn from the signals, indicative of the amplitude of vibrations of the washing chamber or tub along said first axis, provided by the electronic accelerometer, with the information drawn from signals, indicative of the amplitude indicated by the pressure transducing device, and detects operating abnormalities of the pressure transducing device or the electronic accelerometer based on the compared information.

2. The washing machine according to claim 1, wherein the electronic accelerometer is of a three-dimensional type, integrated in a chip.

3. The washing machine according to claim 1, wherein the electronic accelerometer is of a three-dimensional type and is predisposed to provide signals indicative of the amplitude of vibrations of the washing chamber or tub along two further axes.

4. The washing machine according to claim 1, wherein the electronic accelerometer is carried by a plate or board which also carries the microprocessor.

* * * * *